US006734676B2

(12) United States Patent
Leipold et al.

(10) Patent No.: US 6,734,676 B2
(45) Date of Patent: May 11, 2004

(54) METHOD AND TIMING CIRCUIT FOR GENERATING A SWITCHING OR CONTROL SIGNAL

(75) Inventors: Ludwig Leipold, deceased, late of München (DE), by Brigitte Hiebl-Leipold, Stefan-Michael Leipold, legal representatives; Paul Nance, Sunnyvale, CA (US)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 09/997,984

(22) Filed: Nov. 29, 2001

(65) Prior Publication Data

US 2002/0075014 A1 Jun. 20, 2002

Related U.S. Application Data

(63) Continuation of application No. PCT/EP00/09457, filed on Sep. 27, 2000.

(30) Foreign Application Priority Data

Sep. 30, 1999 (DE) ..... 199 46 994

(51) Int. Cl.[7] ..... F02P 17/00

(52) U.S. Cl. ..... 324/380; 324/391

(58) Field of Search ..... 123/435, 467, 123/634, 643, 406.14, 406.19; 324/380, 382, 391

(56) References Cited

U.S. PATENT DOCUMENTS

| | | | | |
|---|---|---|---|---|
| 5,548,471 A | * | 8/1996 | Roederer | 361/253 |
| 5,584,275 A | * | 12/1996 | Taruya | 123/406.14 |
| 5,745,352 A | * | 4/1998 | Sandri et al. | 363/41 |
| 6,006,156 A | * | 12/1999 | Tozzi | 701/114 |
| 6,166,927 A | * | 12/2000 | Farrington et al. | 363/25 |
| 6,505,605 B2 | * | 1/2003 | Yamada et al. | 123/406.14 |

FOREIGN PATENT DOCUMENTS

| | | |
|---|---|---|
| DE | 30 03 892 C2 | 8/1981 |
| GB | 2 069 597 A | 8/1981 |
| GB | 2 141 483 A | 12/1984 |

* cited by examiner

*Primary Examiner*—N. Le
*Assistant Examiner*—Walter Benson
(74) *Attorney, Agent, or Firm*—Laurence A. Greenberg; Werner H. Stemer; Gregory L. Mayback

(57) ABSTRACT

A method for generating a control signal after a predeterminable period of time is described. The method includes applying a voltage to an inductor at a beginning of a time measurement; and outputting, via a current threshold value detector, the control signal if a current through the inductor exceeds a predeterminable threshold value. The invention also relates to a timing circuit.

18 Claims, 2 Drawing Sheets

METHOD AND TIMING CIRCUIT FOR GENERATING A SWITCHING OR CONTROL SIGNAL

CROSS-REFERENCE TO RELATED APPLICATION

This application is a continuation of copending International Application No. PCT/EP00/09457, filed Sep. 27, 2000, which designated the United States.

BACKGROUND OF THE INVENTION

FIELD OF THE INVENTION

The invention relates to a method and also a timing circuit for generating a switching or control signal after a predeterminable period of time.

Timing circuits for switching off a load are usually constructed as so-called RC circuits with a RC element that serves as a timing element.

In electronic ignition systems for internal combustion engines, by way of example, the ignition coil is switched off in such a way that an ignition spark is no longer produced at the spark plug if the drive is operating defectively. The ignition coil can be switched off for example if a maximum temperature is exceeded in the electronic switch that switches the ignition coil on and off. It is more advantageous, however, for the ignition coil to be switched off a predeterminable time after the switch-on process. The predeterminable period of time is chosen to be longer than the switch-on time of the ignition coil in the case of disturbance-free operation. In an electronic ignition system, the switch-on and switch-off times lie in a range of approximately 10 ms to 50 ms.

A timing circuit is suitable for switching off the ignition coil. By way of example, the RC circuit can be used for this purpose, but has the disadvantage that the capacitor cannot be integrated on a chip, but rather has to be provided as an external component. Another, integral solution provides the use of an oscillator and a plurality of binary divider stages. Although this solution has the advantage that all the components can be integrated, it nonetheless requires a high outlay on circuitry.

SUMMARY OF THE INVENTION

It is accordingly an object of the invention to provide a method and a timing circuit for generating a switching or control signal that overcome the above-mentioned disadvantages of the prior art methods and devices of this general type, in which the switching or control signal is formed after a predeterminable period of time, in particular for switching off the ignition coil of an electronic ignition system, which can be integrated without a high outlay on circuitry.

With the foregoing and other objects in view there is provided, in accordance with the invention, a method for generating a control signal after a predeterminable period of time. The method includes the steps of applying a voltage to an inductor at a beginning of a time measurement; and outputting, via a current threshold value detector, the control signal if a current through the inductor exceeds a predeterminable threshold value.

The method according to the invention achieves the object by virtue of the fact that at the beginning of the time measurement, a voltage is applied to an inductor, and that a current threshold value detector outputs the switching or control signal if the current through the inductor exceeds a predetermined threshold value.

In terms of the apparatus, the object is achieved by virtue of the fact that an electric circuit contains a voltage source, a controllable switch, an inductor and also a current threshold value detector with a control output.

In the method according to the invention, the inductor is provided as a timing element. The rise of the current through the inductor is detected by a current threshold value detector, which, in the event of an adjustable and predeterminable threshold value being exceeded, outputs the switching or control signal that, for example, can switch a load on or off. The method according to the invention can be used particularly advantageously in an electronic ignition system of an internal combustion engine, because the ignition coil that is present anyway can serve as the timing element.

A first exemplary embodiment of the method according to the invention provides for the current through the inductor to be detected by a measuring resistor, to whose connections a voltage threshold value detector is connected.

A second exemplary embodiment of the method according to the invention provides for the voltage drop and the current rise at the inductor to be measured and logically combined with one another in a logic circuit. The logic circuit generates the switching or control signal.

A third exemplary embodiment of the method according to the invention is used in an electronic ignition system of an internal combustion engine. The already mentioned current threshold value detector or voltage threshold detector or the logic circuit drives the electronic switch of the electronic ignition system, which switches the ignition coil on and off. After the predetermined period of time, the current threshold detector, the voltage threshold value detector or the logic circuit outputs a switching signal for switching off the ignition coil.

A fourth exemplary embodiment of the method according to the invention, when used in an electronic ignition system for an internal combustion engine, provides for the current through the ignition coil to be switched off in the event of a short circuit on the ignition coil.

In accordance with an added mode of the invention, there are the steps of flowing the current through a measuring resistor, and measuring a voltage drop across the measuring resistor using a voltage threshold value detector, the voltage drop serving as a measure of the current through the inductor.

In accordance with an additional mode of the invention, there are the steps of measuring a current rise at the inductor, and logically combining the voltage drop and the current rise in a logic circuit, and the logic circuit generates the control signal.

In accordance with another mode of the invention, there is the step of using the current threshold value detector, the voltage threshold value detector or the logic circuit to drive an electronic switch, the electronic switch switches off the current through the inductor.

In accordance with a further mode of the invention, there are the steps of measuring the current rise at the inductor and a voltage drop across the electronic switch, and logically combining the current rise and the voltage drop across the electronic switch with one another in the logic circuit. As a result the logic circuit outputs the control signal.

In accordance with a further added mode of the invention, there is the step of using the inductor as an ignition coil of an ignition system of an internal combustion engine.

In accordance with a further additional mode of the invention, there is the step of switching off the current through the ignition coil in an event of a short circuit on the ignition coil.

In accordance with another further mode of the invention, there is the step of switching off the current through the ignition coil with regards to a differential quotient dI/dt which is chosen to be small enough that no ignition spark is generated at spark plugs connected to the ignition coil.

In accordance with a concomitant mode of the invention, there is the step of forming the control signal as a switching signal.

With the foregoing and other objects in view there is provided, in accordance with the invention, a timing circuit for generating a control signal after a predeterminable period of time. The timing circuit contains an electric circuit having a voltage source, a controllable switch connected to the voltage source, an inductor connected to the controllable switch, and a current threshold value detector with a control output connected to the inductor.

In accordance with an added feature of the invention, the current threshold value detector has a voltage threshold value detector with a control output and a measuring resistor connected in parallel with the voltage threshold value detector.

In accordance with an additional feature of the invention, the controllable switch has a control input; and the inductor is a primary winding of an ignition coil of an electronic ignition system of an internal combustion engine. The control output of the current threshold value detector is connected to the control input of the controllable switch.

In accordance with another feature of the invention, the controllable switch has a control input; and the inductor is a primary winding of an ignition coil of an electronic ignition system of an internal combustion engine. The control output of the voltage threshold value detector is connected to the control input of the controllable switch.

In accordance with a further feature of the invention, the controllable switch is a field-effect transistor. More specifically, the field-effect transistor is an insulated gate bipolar transistor.

In accordance with a further added feature of the invention, the voltage source has a first pole and a second pole. The controllable switch is a field-effect transistor having a collector terminal, a gate electrode, a first emitter terminal and a second emitter terminal. The current threshold value detector has a further voltage threshold value detector with a first input, a second input, a third input and an output. The current threshold value detector has a logic circuit with a first input, a second input, a first output and a second output. The primary winding of the ignition coil has a first terminal connected to the first pole and to the first input of the further voltage threshold detector, a second terminal connected to the second input of the further voltage threshold value detector and to the collector terminal of the field-effect transistor. The first emitter of the field-effect transistor is connected through the measuring resistor to the gate electrode of the field-effect transistor, to the first output of the logic circuit, to the third input of the further voltage threshold value detector and to the second pole of the voltage source. The measuring resistor has a first terminal connected to the first input of the voltage threshold value detector. The voltage threshold value detector has an output connected to the first input of the logic circuit. The output of the further voltage threshold value detector is connected to the second input of the logic circuit. The second output of the logic circuit is connected to the gate electrode of the field-effect transistor.

In accordance with a concomitant feature of the invention, the second emitter terminal of the field-effect transistor is connected in parallel with a series circuit of the first emitter terminal and the measuring resistor.

Other features which are considered as characteristic for the invention are set forth in the appended claims.

Although the invention is illustrated and described herein as embodied in a method and a timing circuit for generating a switching or control signal, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
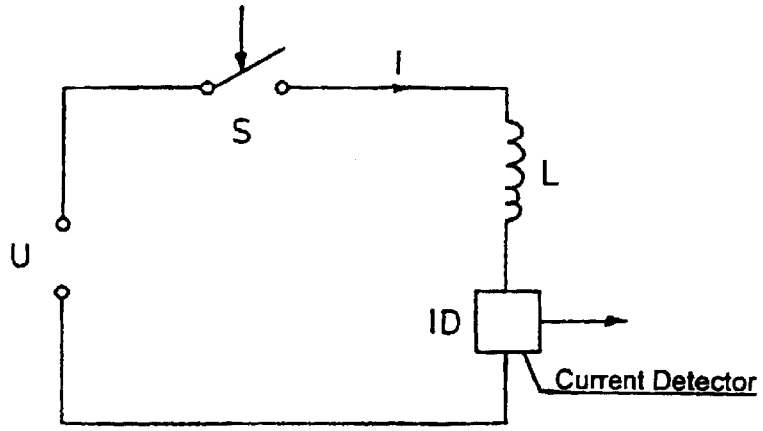
FIG. 1 is a block circuit diagram of a first exemplary embodiment of a timing circuit according to the invention.

Referring now to the figures of the drawing in detail and first, particularly, to FIG. 1 thereof, there is shown a first exemplary embodiment of a timing circuit according to the invention which will now be described and explained.

An electric circuit contains a voltage source U, a controllable switch S, an inductor L and a current threshold value detector ID with a control output.

The timing circuit is switched on by the closing of the controllable switch S, which can be actuated by a control circuit, for example. If a current I through the inductor L exceeds a predeterminable and adjustable threshold value, the current threshold value detector ID outputs at its output a switching or control signal which, for example, may serve for controlling or switching a load on and off.

When the first exemplary embodiment of the timing circuit according to the invention is used in an electronic ignition system for an internal combustion engine, the control output of the current threshold value detector ID is connected to a control input of the controllable switch S, which switches the inductor L—the ignition coil—on and off.

The second exemplary embodiment—shown in FIG. 2—of the timing circuit according to the invention will now be described and explained.

Figure 2:
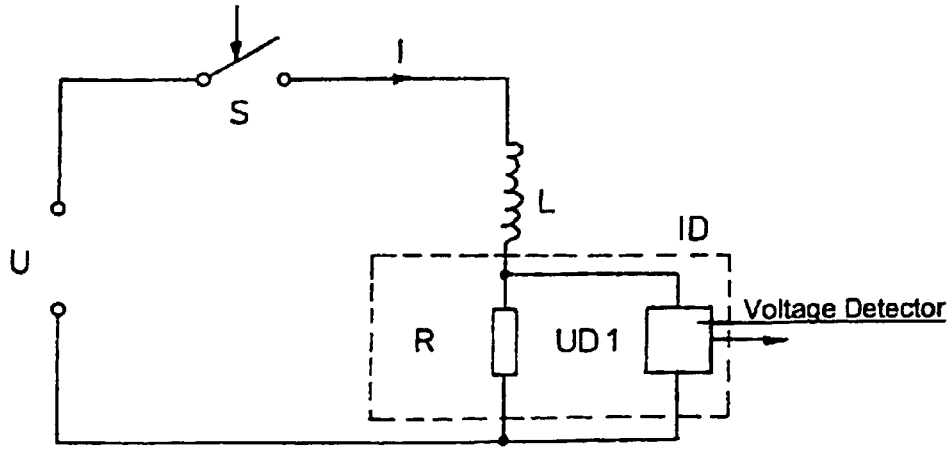
FIG. 2 is a block circuit diagram of a second exemplary embodiment of the timing circuit according to the invention.

The construction of the current threshold value detector ID is shown in the second exemplary embodiment of the timing circuit according to the invention shown in FIG. 2. The electric circuit contains the voltage source U, the controllable switch S, the inductor L and a measuring resistor R, to whose connections a voltage threshold value detector UD1 is connected. The measuring resistor R and the voltage threshold value detector UD1 form the current threshold value detector ID.

The second exemplary embodiment can also be used in an electronic ignition system. A control output of the voltage threshold value detector UD1 is connected to the control input of the controllable switch S, which switches the ignition coil L on and off.

Figure 3:
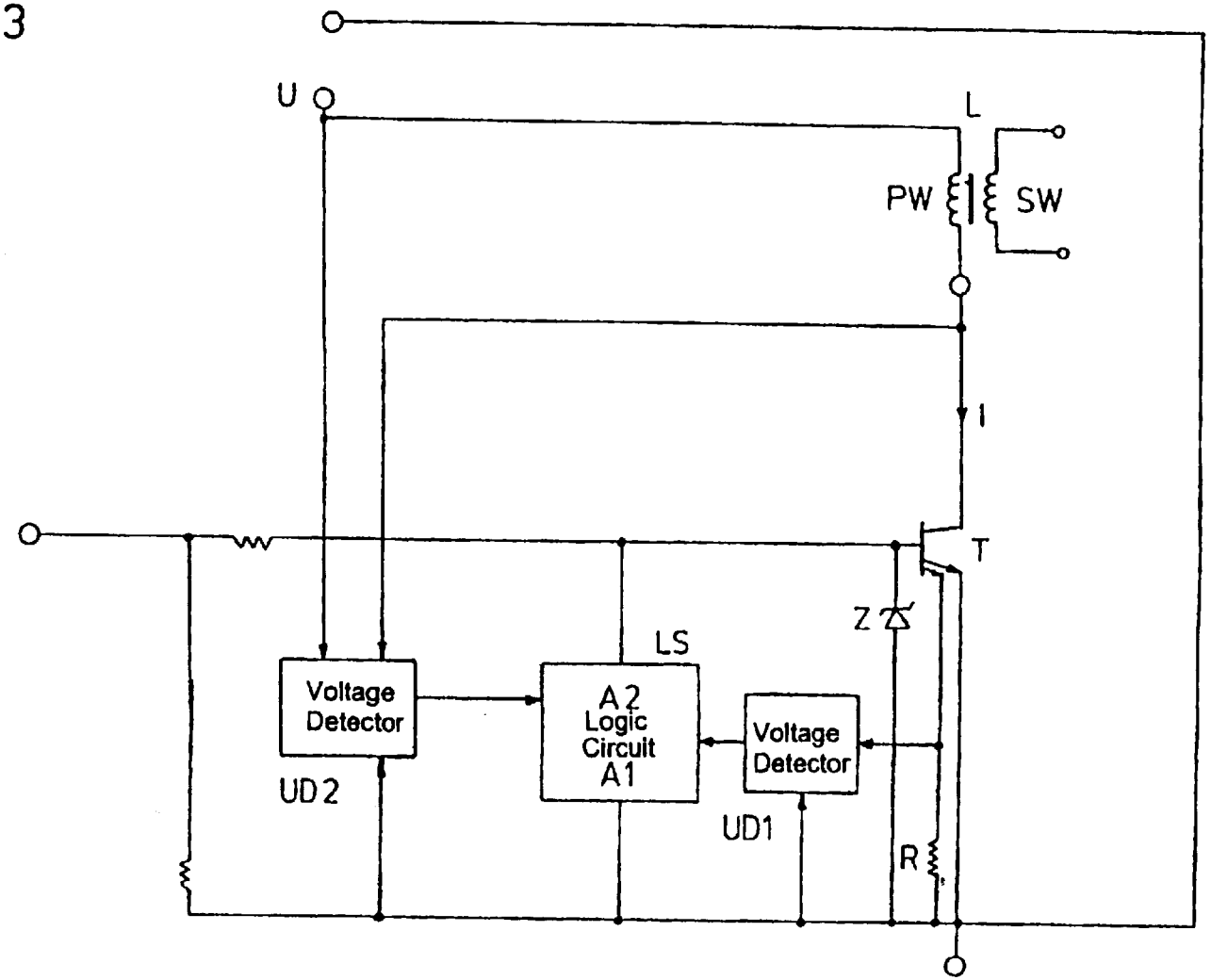
FIG. 3 is a block circuit diagram of a third exemplary embodiment of the timing circuit according to the invention, the third exemplary embodiment being incorporated in an electronic ignition system for an internal combustion engine.

The third exemplary embodiment of the timing circuit according to the invention, the third exemplary embodiment being incorporated in an electronic ignition system and is shown in FIG. 3, will now be described and explained.

In FIG. 3, one connection of a primary winding PW of the ignition coil L is connected to one pole of the voltage source U—the vehicle battery—and a first input of a second voltage threshold detector UD2. A second connection of the primary winding PW of the ignition coil L is connected to the second input of the second voltage threshold value detector UD2 and to a collector of a field-effect transistor T, which constitutes the controllable switch S. A first emitter of the field-effect transistor T is connected through the measuring resistor R to its gate electrode, to a first output A1 of a logic circuit LS, to a third input of the second voltage threshold value detector UD2 and to the other pole of the voltage source U. One connection of the measuring resistor R is connected to a first input of the first voltage threshold value detector UD1 and the other connection of the measuring resistor R is connected to the second input of the first voltage threshold value detector UD1. An output of the first voltage threshold value detector UD1 is connected to the first input of the logic circuit LS. The output of the voltage threshold value detector UD2 is connected to the second input of the logic circuit LS, whose second output A2 is connected to the gate electrode of the field-effect transistor T. A second emitter of the field-effect transistor T is connected in parallel with the first emitter of the field-effect transistor T and with the measuring resistor R. A zener diode Z is connected in parallel with the gate electrode and with the emitter of the field-effect transistor T.

A so-called insulated gate bipolar transistor is preferably used for the field-effect transistor T.

The function of the third exemplary embodiment of the invention shown in FIG. 3 will now be explained.

The current through the primary winding PW of the ignition coil L is switched on and off cyclically by the field-effect transistor T, in order to generate an ignition spark at the correct instant at the spark plugs connected to the secondary winding SW of the ignition coil L. When the field-effect transistor T is in the on state, the current I through the primary coil PW of the ignition coil L rises linearly. According to the invention, the linear rise of the current I serves for time measurement purposes.

In the case of disturbance-free operation, the field-effect transistor T is switched on and off cyclically, in order that the ignition coil supplies the ignition voltage required for the spark plugs at the correct instant. If no ignition spark is generated at the ignition instant on account of a disturbance, the current I through the primary winding PW of the ignition coil L continues to rise linearly. In order to prevent the ignition coil from being destroyed by excessively high current, the field-effect transistor T is controlled by the logic circuit LS from the on state to the off state so slowly that the differential quotient dI/dt of the current flowing through the primary winding PW of the ignition coil L remains small enough that the ignition voltage induced on the secondary winding SW of the ignition coil L no longer suffices to generate an ignition spark at the spark plugs. Ignition sparks outside the ignition instance are thereby avoided.

The voltage threshold value detector UD1 detects a voltage drop across the measuring resistor R, which is proportional to the current I flowing through the primary winding PW of the ignition coil L. The voltage threshold value detector UD2 detects the voltage drop across a collector-emitter path of the field-effect transistor T. The threshold value set in the voltage threshold value detector UD1 is chosen to be greater than the value of the voltage drop across the measuring resistor R at the ignition instant. In the case of disturbance-free operation, the value set in the voltage threshold value detector UD1 is therefore never reached. By contrast, the current I through the primary coil PW and thus the voltage drop across the measuring resistor R rise in the event of a disturbance, that is to say if the field-effect transistor T is not switched off at the ignition instant, beyond the threshold value set in the voltage threshold value detector UD1. At the same time, the voltage across the collector-emitter path of the field-effect transistor T, which is detected by the voltage threshold value detector UD2, falls below the collector-emitter saturation voltage. If both the first condition, wherein the current I through the primary winding PW of the ignition coil L exceeds the predeterminable threshold value, and the second condition, wherein the voltage across the collector-emitter path of the field-effect transistor T equals or becomes <the collector-emitter saturation voltage, the logic circuit LS outputs a control signal to the gate electrode of the field-effect transistor T, which transfers the latter from the on state to the off state so slowly that the differential quotient ID/dT of the current I flowing through the primary winding PW of the ignition coil L no longer suffices to induce, on the secondary winding SW of the ignition coil L, an ignition voltage having a magnitude required to generate an ignition spark.

In the event of a short circuit on the ignition coil L, the collector-emitter voltage of the field-effect transistor T significantly exceeds the saturation voltage, and this is detected by the voltage threshold value detector UD2. When the collector-emitter voltage of the field-effect transistor T significantly exceeds the saturation voltage, the voltage threshold value detector UD2 outputs a control signal to the logic circuit LS, which thereupon immediately controls the field-effect transistor T into the off state. In the event of a short circuit on the ignition coil L, the current through the primary winding PW of the ignition coil L can be immediately switched off, because, in this case, no voltage is induced in the secondary winding SW of the ignition coil L and, therefore, no ignition spark can be generated either.

Since the inductor L is provided as the timing element in the method according to the invention and in the timing circuit according to the invention, neither a RC element nor an oscillator with subsequent binary divider stages is necessary. The invention is therefore suitable in particular for an electronic ignition system, because an electronic ignition system contains an inductor—the ignition coil—anyway, which performs a dual function. It generates the ignition voltage and simultaneously serves as the timing element. The invention is particularly well suited to circuit configurations or systems in which an inductor is provided, which can then additionally be utilized as a timing element.

However, the invention is in no way restricted to such circuits or systems having an inductor already present. It can advantageously be used whenever comparatively long times are to be measured. If an inductor is not already present in the area of application, and it can be utilized as a timing element, an inductor should be provided as the timing element.

The ignition system according to the invention requires only two voltage threshold value detectors and a logic circuit, which constitute only a small outlay and, moreover, can easily be integrated on a chip.

We claim:

1. A method for generating a control signal after a predeterminable period of time, which comprises the steps of:

applying a voltage to an inductor using an electronic switch at a beginning of a time measurement;

measuring a current rise at the inductor and a voltage drop across the electronic switch;

logically combining the current rise at the inductor and the voltage drop across the electronic switch in a logic circuit configured to generate the control signal based in part on the current rise at the inductor and the voltage drop across the electronic switch; and outputting the control signal.

2. The method according claim 1, which comprises flowing the current through a measuring resistor, and measuring a voltage drop across the measuring resistor using a voltage threshold value detector, the voltage drop serving as a measure of the current through the inductor.

3. The method according to claim 2, which comprises measuring a current rise at the inductor, and logically combining the voltage drop and the current rise in a logic circuit, and the logic circuit generates the control signal.

4. The method according to claim 3, which comprises using one of the current threshold value detector, the voltage threshold value detector and the logic circuit to drive an electronic switch, the electronic switch switches off the current through the inductor.

5. The method according to claim 1, which comprises using the inductor as an ignition coil of an ignition system of an internal combustion engine.

6. The method according to claim 5, which comprises switching off the current through the ignition coil in an event of a short circuit on the ignition coil.

7. The method according to claim 5, which comprises switching off the current through the ignition coil with regards to a differential quotient dI/dt which is chosen to be small enough that no ignition spark is generated at spark plugs connected to the ignition coil.

8. The method according to claim 1, which comprises forming the control signal as a switching signal.

9. A timing circuit for generating a control signal after a predeterminable period of time, comprising:

an electric circuit having a voltage source with a first pole and a second pole;

a controllable switch connected to said voltage source, said controllable switch having a field effect transistor with a collector terminal, a gate electrode, a first emitter terminal and a second emitter terminal;

an inductor connected to said controllable switch, said controllable switch configured to apply a voltage to said inductor, said inductor being a primary winding of an ignition coil having a first terminal and a second terminal, said first terminal being connected to said first pole; and a current threshold value detector with a control output connected to said inductor, said current threshold value detector having a voltage threshold value detector for measuring a current rise at said inductor and a voltage drop across the electronic switch and a logic circuit for combining the measured current rise with the measured voltage drop;

said voltage threshold value detector having a first input connected to the first terminal of the ignition coil, a second input connected to the second terminal of the ignition coil, a third input, and a control output connected to said logic circuit.

10. The timing circuit according to claim 9, wherein said current threshold value detector has a measuring resistor connected in parallel with said voltage threshold value detector.

11. The timing circuit according to claim 9, wherein:

said controllable switch has a control input; and said control output of said current threshold value detector is connected to said control input of said controllable switch.

12. The timing circuit according to claim 9, wherein:

said controllable switch has a control input; and said control output of said voltage threshold value detector is connected to said control input of said controllable switch.

13. The timing circuit according to claim 9, wherein said controllable switch is a field-effect transistor.

14. The timing circuit according to claim 13, wherein said field-effect transistor is an insulated gate bipolar transistor.

15. The timing circuit according to claim 11, wherein:

said voltage source has a first pole and a second pole;

said controllable switch is a field-effect transistor having a collector terminal, a gate electrode, a first emitter terminal and a second emitter terminal;

said current threshold value detector has a further voltage threshold value detector with a first input, a second input, a third input and an output;

said current threshold value detector has a logic circuit with a first input, a second input, a first output and a second output;

said primary winding of said ignition coil has a first terminal connected to said first pole and to said first input of said further voltage threshold detector, a second terminal connected to said second input of said further voltage threshold value detector and to said collector terminal of said field-effect transistor;

said first emitter of said field-effect transistor connected through said measuring resistor to said gate electrode of said field-effect transistor, to said first output of said logic circuit, to said third input of said further voltage threshold value detector and to said second pole of said voltage source;

said measuring resistor has a first terminal connected to said first input of said voltage threshold value detector;

said voltage threshold value detector has an output connected to said first input of the logic circuit;

said output of said further voltage threshold value detector connected to said second input of said logic circuit; and said second output of said logic circuit connected to said gate electrode of said field-effect transistor.

16. The timing circuit according to claim 15, wherein said second emitter terminal of said field-effect transistor is connected in parallel with a series circuit of said first emitter terminal and said measuring resistor.

17. The timing circuit according to claim 15, wherein said current threshold value detector has a zener diode connected between said gate electrode and said second emitter terminal of said field-effect transistor.

18. The timing circuit according to claim 9, wherein said ignition coil is configured for use in an electronic ignition system of an internal combustion engine.

* * * * *